US006603135B2

(12) United States Patent
Spatafora

(10) Patent No.: US 6,603,135 B2
(45) Date of Patent: Aug. 5, 2003

(54) METHOD OF DETECTING THE POSITION OF STACKS OF BLANKS FOR SUPPLY TO A CIGARETTE PACKING MACHINE

(75) Inventor: Mario Spatafora, Bologna (IT)

(73) Assignee: G.D. Societa' per Azioni, Bologna (IT)

( * ) Notice: Subject to any disclaimer, the term of this patent is extended or adjusted under 35 U.S.C. 154(b) by 0 days.

(21) Appl. No.: 09/864,989

(22) Filed: May 24, 2001

(65) Prior Publication Data

US 2001/0045214 A1 Nov. 29, 2001

(30) Foreign Application Priority Data

May 25, 2000 (IT) ..... BO00A0318

(51) Int. Cl.[7] ..... G01N 21/86

(52) U.S. Cl. ..... 250/559.29; 250/559.44; 356/614; 209/536

(58) Field of Search ..... 250/559.29–559.33, 250/559.39, 559.44, 234, 235; 356/429, 614; 209/535, 536

(56) References Cited

U.S. PATENT DOCUMENTS 4,511,045 A * 4/1985 Seragnoli ..... 209/535
4,813,659 A 3/1989 Neri
5,793,051 A * 8/1998 Stern et al. ..... 250/559.2

* cited by examiner

*Primary Examiner*—Stephone B. Allen
*Assistant Examiner*—Christopher Glass
(74) *Attorney, Agent, or Firm*—Marshall, Gerstein & Borun

(57) ABSTRACT

A method of detecting the positions occupied on a pallet by stacks of blanks arranged on the pallet in a number of superimposed layers and, in each layer, in a number of side by side rows, to enable automatic pickup of each stack and supply of the stack to a cigarette packing machine; the method including the step of moving a sensor along each row to determine a lateral contour of the row close to bases of the relative stacks.

4 Claims, 2 Drawing Sheets

METHOD OF DETECTING THE POSITION OF STACKS OF BLANKS FOR SUPPLY TO A CIGARETTE PACKING MACHINE

The present invention relates to a method of detecting the position of stacks of blanks for supply to a cigarette packing machine.

BACKGROUND OF THE INVENTION

In the packing of cigarettes, stacks of blanks, each comprising a number of superimposed blanks, are fed individually to the input of a packing machine.

Normally, the stacks of blanks are originally arranged on a pallet in a number of superimposed layers separated by rigid boards, and in a number of side by side rows in each layer; the pallet so loaded is located in a given standard position close to the input; and the packing machine is normally equipped with an automatic transfer unit by which each stack is located, is removed from the relative row in the relative layer, and is fed to the input.

Known automatic transfer units normally comprise a pickup head for removing each stack off the pallet, and which is associated with an at least four-axis operating machine for imparting to the pickup head the movements required to pick up the stack. Known automatic transfer units also comprise a sensor device, normally movable with the pickup head, for determining the position and orientation of the stack, and for enabling a central control unit to accurately control the pickup movements. In this connection, it should be pointed out that the location of each stack is a "final location", seeing as how the central control unit already knows from the outset the shape and size of the blanks, a presumed (standard) position of the pallet with respect to the operating machine, a presumed distribution of the layers of stacks on the pallet, a presumed position and orientation of each row of stacks in the relative layer and of each stack in the relative row, and therefore a presumed position and orientation of each stack on the relative board.

Before each stack is removed (from the free top layer on the pallet), the sensor device takes a first reading to determine the height of the board supporting the layer containing the stack to be removed (this is normally done once for each layer, or may even be dispensed with if the operating machine is designed to move the pallet vertically so that the board supporting the stack to be removed is always set to a given fixed height), and then takes a second reading to determine the position and orientation of the stack on the board.

Using known sensor devices, the second reading is made by moving the sensor device in an observation plane, parallel to the plane of the board supporting the stack and over the top of the stack, and about the presumed position of the projection of the stack in the observation plane, and by determining the position of at least two (but normally three) conspicuous points of the top blank in the stack.

Taking the second reading as described above involves several drawbacks on account of the position and orientation of the stack being determined on the basis of the position and orientation of the top blank, i.e. without taking into consideration the possibility, as often occurs, of the stack being deformed, so that the horizontal position of the top blank no longer corresponds, when the stack is removed, to the position of the bottom blank, which is the one normally engaged by the pickup head to supply the stack to the packing machine.

In other words, the method employed by known sensors of the type described above may result in mislocation of the stack, and also in possible damage to the stack by the pickup head.

SUMMARY OF THE INVENTION

It is an object of the present invention to provide a method of detecting the position of stacks of blanks for supply to a cigarette packing machine, designed to eliminate the aforementioned drawbacks.

According to the present invention, there is provided a method of detecting the position of stacks of blanks for supply to a cigarette packing machine; said stacks having respective bases resting on a plane; and the method comprising the step of moving a sensor along a line parallel to said plane and extending alongside said stacks in a given direction to determine the position and orientation of each said base with respect to said line by determining a contour of a lateral edge of at least one given blank, in each said stack, located close to the relative said base.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
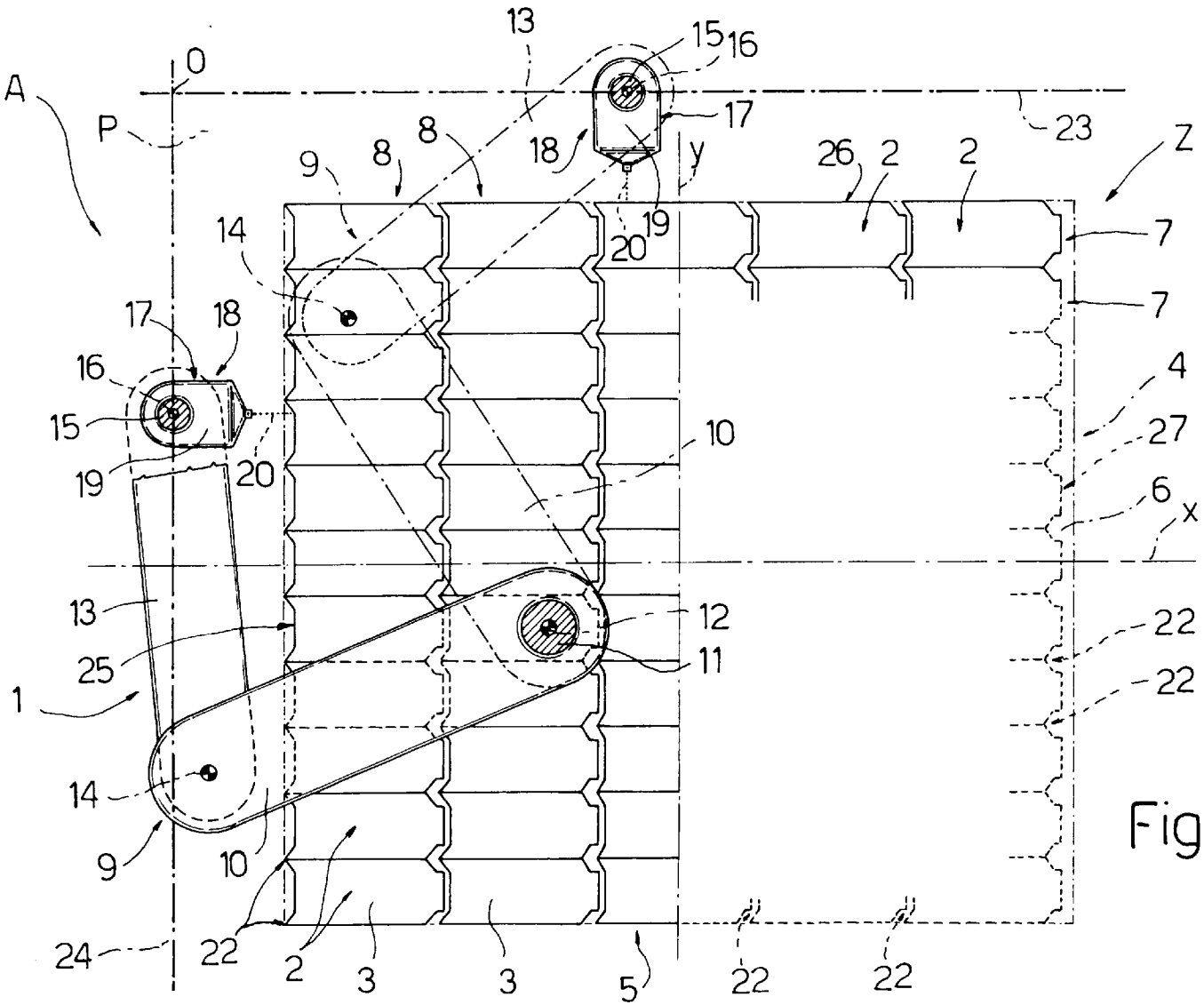
FIG. 1 shows a plan view, with parts in section and parts removed for clarity, of a preferred embodiment of a unit implementing the method according to the present invention.
Figure 2:
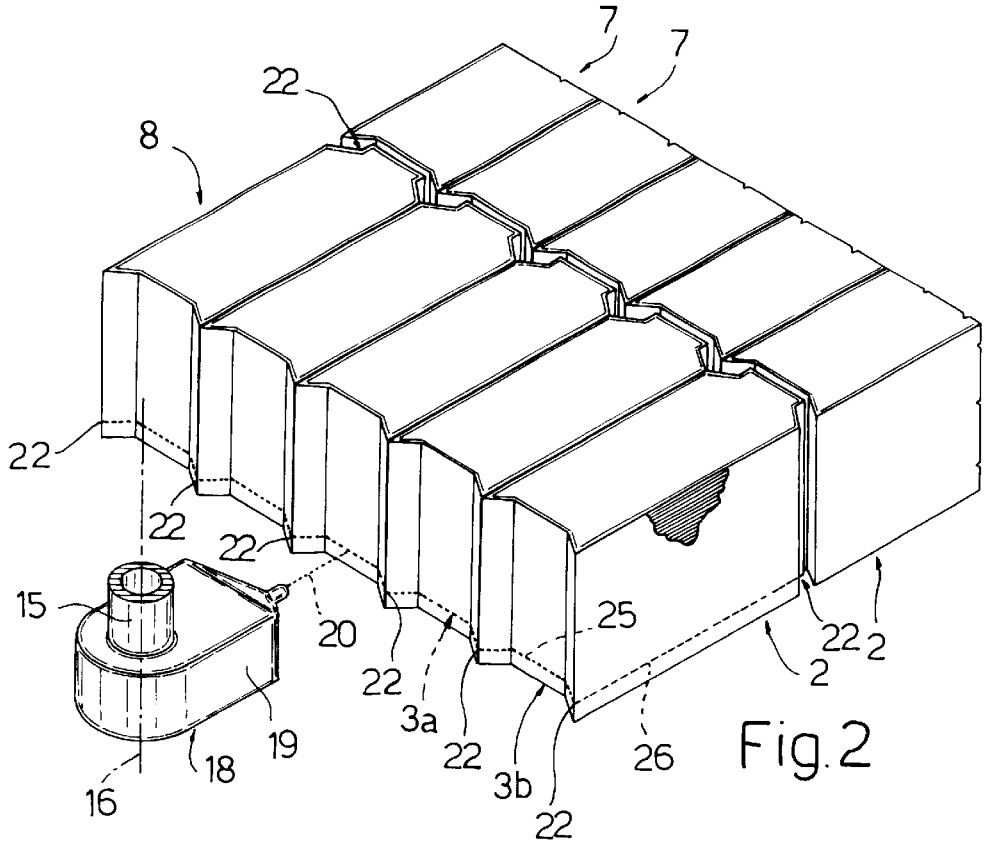
FIG. 2 shows a larger-scale side view, with parts removed for clarity, of a detail in FIG. 1.

With reference to FIGS. 1 and 2, number 1 indicates as a whole a unit for transferring stacks 2 of blanks 3, and which constitutes a loading unit for loading a cigarette packing machine A.

Stacks 2 comprise respective numbers of superimposed blanks 3, and are arranged on a pallet 4 in a number of superimposed layers 5—of which only the top layer 5 is shown—separated by respective substantially rectangular, horizontal boards 6 normally made of sheet material, and of which only the board 6 supporting the top layer 5 is shown for the sake of simplicity.

Stacks 2 in each layer 5 are equioriented, and are arranged side by side on relative board 6 to define a first number of rows 7 and a second number of rows 8 perpendicular to rows 7, so that each stack 2 is located on relative board 6 at the intersection of a relative row 7 and a relative row 8. In actual use, pallet 4 is located as far as possible in a standard position within a given loading region Z beneath transfer unit 1, and with rows 7 and 8 as parallel as possible to two given horizontal axes X and Y.

Unit 1 comprises an articulated arm 9 in turn comprising an arm 10 fitted to a powered vertical shaft 11 to rotate about a fixed axis 12 coaxial with shaft 11 and close to the intersection of axes X and Y, and a further arm 13 hinged at one end to a free end of arm 10, and rotated, with respect to arm 10 and by a known transmission not shown, about an axis 14 parallel to axis 12. Arm 13 is he same length as arm 10 and is fitted on the free end with a powered swivel shaft 15 having an axis 16 parallel to axis 12, and to which is suspended a pickup head 17. Of this, only portion is shown, for the sake of simplicity, defined by a detecting device 18 comprising an optical sensor 19, e.g. a laser sensor for emitting a beam 20 which, on encountering a point on a surface, is reflected back to cause sensor 19 to emit a signal of an intensity proportional to the distance between the point and sensor 19.

Pickup head 17, of known type, may be fitted to articulated arm 9 at any point within loading region Z, and can be oriented by shaft 15 to selectively grip stacks 2 in top layer 5, and feed stacks 2 successively to the input (not shown) of a packing unit (not shown) of packing machine A.

As shown in FIG. 2, each blank 3 is positioned on pallet 4 with a longitudinal axis of symmetry 21 (FIG. 3) of the blank substantially parallel to relative row 7; and the peripheral edges of the blank, when observed laterally in any direction parallel to the plane of blank 3 and substantially parallel or substantially perpendicular to axis of symmetry 21, have at least two singular points 22.

Figure 3:
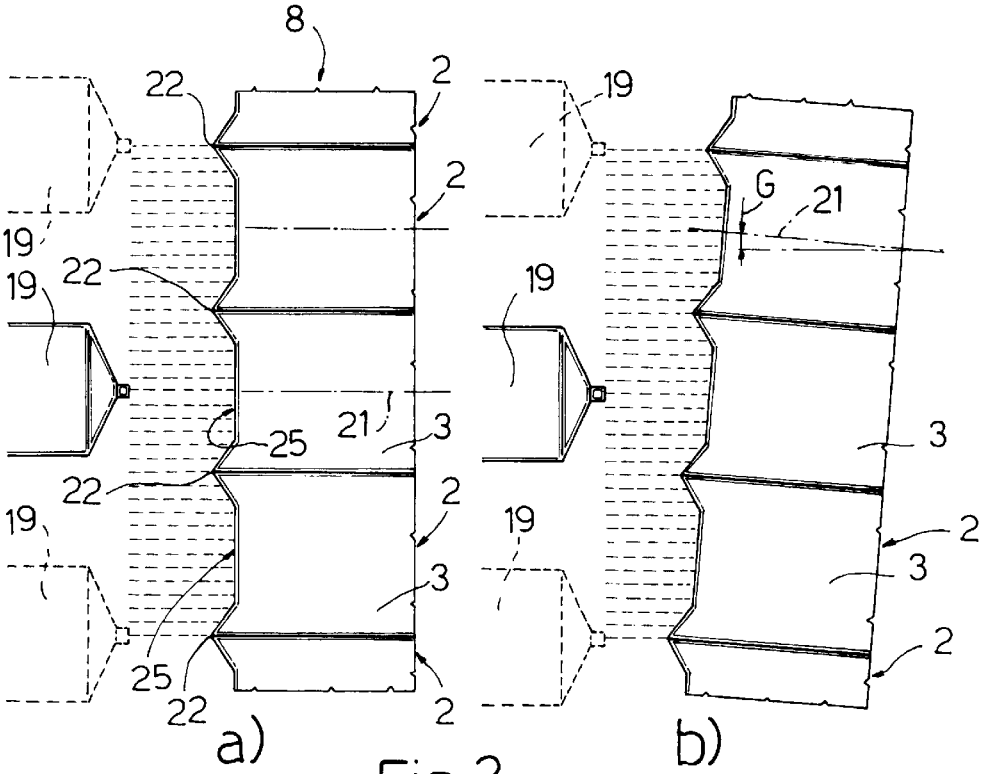
FIG. 3 shows a larger-scale view of a FIG. 1 detail in two different positions.

In actual use, and with reference to FIGS. 2 and 3, once pallet 4 is set in the standard position beneath transfer unit 1, articulated arm 9 is activated to so position axis 16 as to pass through a point 0 at the intersection of two lines 23 and 24, which are parallel to axes X and Y respectively, are located outwards of top layer 5 on pallet 4, and are substantially parallel to and face respective lateral edges of a number of blanks 3*a*, each forming part of a respective stack 2 in top layer 5, and each lying in an observation plane P defined by lines 23 and 24 and located a given, relatively small distance from the bottom blanks 3*b* in stacks 2.

A relative vertical movement between articulated arm 9 and pallet 4 is then effected (by vertically moving pallet 4 and lines 23 and 24 with respect to articulated arm 9, or articulated arm 9 with respect to pallet 4 and lines 23 and 24) to so position sensor 19 as to emit a beam 20 coplanar with observation plane P. And finally, pickup head 17 is rotated about axis 16 to orient beam 20 towards pallet 4 and in a direction parallel to line 23.

At this point, sensor 19 is moved along line 24 so that, of each blank 3*a* in stacks 2, beam 20 sweeps an edge 25 oriented in a direction substantially parallel to line 24 and perpendicular to relative longitudinal axis of symmetry 21.

As a result of the sensor traveling along line 24, a known central control unit (not shown), connected to sensor 19, determines, along each edge 25 of each blank 3*a* in an outer row 8 facing sensor 19, at least two singular points 22, of which it comes to know the respective distances from line 24 and therefore, given the movement of sensor 19 along line 24, the precise positions in observation plane P. By working out the difference between the distances of singular points 22 of each blank 3*a* from line 24, the central control unit (not shown) is able to determine (FIG. 3*b*) any angle G (which will only be other than zero if the orientation of stacks 2 is other than the standard one shown in FIG. 3*a*) formed between the longitudinal axis 21 of each blank 3*a* and line 23, and therefore the actual position and orientation in plane P of each blank 3*a* in the outer row 8.

Since, given the minimum distance between each blank 3*a* and relative blank 3*b*, the position of each blank 3*a* with respect to relative blank 3*b*, which is in a substantially fixed position on relative board 6, is assumed to be unaffected by any deformation of relative stack 2, the central control unit (not shown) is able, at this point, to guide the pickup head 17 extremely accurately to pick up the relative stack 2.

The above considerations also apply in the event sensor 19 is moved along line 23, or along a line (not shown) parallel to line 24 and lying in observation plane P, but on the opposite side of pallet 4 to line 24.

In these two cases, the central control unit (not shown) will determine the positions of further singular points 22 along edges 26 and 27 of blanks 3*a* respectively.

What is claimed is:

1. A method of detecting the position of stacks of blanks for supply to a cigarette packing machine; each said stack (2) having a respective base (3*b*) resting on a plane (6) and having a lateral edge (25; 26; 27), which has two singular points (22) and is freely accessible; and the method comprising the step of moving a sensor (19) along a line (23; 24) parallel to said plane (6), facing said singular points (22), and extending alongside said stacks (2) in a given direction to determine the position and orientation of each said base (3*b*) with respect to said line (23; 24) by determining a contour of said lateral edge (25; 26; 27) of at least one given blank (3*a*), in each said stack (2), located close to the relative said base (3*b*); the position and orientation of each said base (3*b*) being calculated by determining the distances of said two singular points (22) from said line (23; 24).

2. A method as claimed in claim 1, characterized in that said stacks (2) are arranged on said plane (6) in at least one row (7; 8); said line (23; 24) extending along said row (7; 8) and laterally with respect to the row (7; 8).

3. A method as claimed in claim 1, characterized in that said given blank (3*a*) in each said stack (2) has a longitudinal axis (21) of symmetry; said line (23) being substantially parallel to said longitudinal axis (21) of symmetry.

4. A method as claimed in claim 1, characterized in that said given blank (3*a*) in each said stack (2) has a longitudinal axis (21) of symmetry; said line (24) being substantially perpendicular to said longitudinal axis (21) of symmetry.

* * * * *